US005871875A

United States Patent [19]

Chambers et al.

[11] Patent Number: 5,871,875

[45] **Date of Patent: *Feb. 16, 1999**

[54] PROCESS FOR PREPARING ELECTROPHOTOGRAPHIC IMAGING MEMBER

[75] Inventors: John S. Chambers, Rochester; Huoy-Jen Yuh, Pittsford, both of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 782,234

[22] Filed: Jan. 13, 1997

[51] Int. Cl.[6] ..... G03G 5/04

[52] U.S. Cl. ..... 430/56; 430/73; 430/96; 430/133; 430/134

[58] Field of Search ..... 430/96, 134, 56, 430/133, 73; 106/239

[56] References Cited

U.S. PATENT DOCUMENTS

| | | | |
|---|---|---|---|
| 3,904,407 | 9/1975 | Regensburger et al. . | |
| 4,587,189 | 5/1986 | Ah-Mee Hor et al. . | |
| 4,855,203 | 8/1989 | Badesha et al. . | |
| 5,350,654 | 9/1994 | Pai et al. . | |
| 5,395,722 | 3/1995 | Nukada et al. . | |
| 5,521,047 | 5/1996 | Yuh et al. . | |
| 5,532,103 | 7/1996 | Markovics et al. | 430/131 |
| 5,547,790 | 8/1996 | Umeda et al. . | |

FOREIGN PATENT DOCUMENTS

| | | |
|---|---|---|
| 155995 | 7/1982 | Germany . |
| 7-036198 | 2/1995 | Japan . |
| 7-163938 | 6/1995 | Japan . |
| 7-219254 | 8/1995 | Japan . |

OTHER PUBLICATIONS

Chemical Abstracts 98:107975. 1982.

Chemical Abstracts 124:71555. Aug. 1995.

Chemical Abstracts 123:289765 1995.

Borsenberger, Paul M. & David S. Weiss. Organic Photoreceptors for Imaging Systems, New YorK; Marcel–Dekker, Inc. pp. 190–211. 1993.

*Primary Examiner*—Christopher D. Rodee

*Attorney, Agent, or Firm*—Oliff & Berridge, PLC

[57] ABSTRACT

An electrophotographic imaging member is prepared by forming a dispersion of a charge transport material in a solvent system including at least two non-chlorinated solvents selected from tetrahydrofuran, dioxane and toluene, and applying the dispersion to an electrophotographic imaging member layer by solution coating.

21 Claims, No Drawings

PROCESS FOR PREPARING ELECTROPHOTOGRAPHIC IMAGING MEMBER

BACKGROUND OF THE INVENTION

This invention relates in general to electrophotography and, in particular, to a process for preparing electrophotographic imaging members containing a charge transport layer formed using non-chlorinated solvents.

In electrophotography, the surface of an electrophotographic plate, drum, belt or the like (hereinafter referred to simply as an imaging member) containing a photoconductive insulating layer on a conductive layer is first uniformly electrostatically charged. The imaging member is then exposed to a pattern of activating electromagnetic radiation such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly to a print substrate, such as paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material.

In addition, the imaging member may be layered. Current layered organic imaging members have at least a substrate layer and two active layers: (1) a charge generating layer containing a light-absorbing material, and (2) a charge transport layer containing electron donor molecules.

The substrate layer may be formed from a conductive material. In addition, a conductive layer can be formed on a nonconductive substrate.

The charge generating layer is capable of photogenerating charge and injecting the photogenerated charge into the charge transport layer. U.S. Pat. No. 4,855,203 to Miyaka teaches charge generating layers comprising a resin dispersed pigment. Suitable pigments include photoconductive zinc oxide or cadmium sulfide and organic pigments such as a phthalocyanine type pigment, a polycyclic quinone type pigment, a perylene pigment, an azo type pigment and a quinacridone type pigment.

In the charge transport layer, the electron donor molecules may be in a polymer binder. In this case, the electron donor molecules provide hole or charge transport properties, while the electrically inactive polymer binder provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating layer and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

Suitable coating methods used for applying the various layers to electrophotographic imaging members include dip coating, roll coating, Meyer bar coating, bead coating, curtain flow coating and vacuum deposition. Solution coating is a preferred approach because it is more economical than vacuum coating and can be used to deposit a seamless layer.

U.S. Pat. No. 5,547,790 to Umeda et al. teaches applying charge transport layers from coating solutions comprising a charge transport material and suitable organic solvents including tetrahydrofuran, dioxane, toluene, monochlorobenzene, dichloroethane, methylene chloride and cyclohexanone.

Chlorinated solvents, such as those described above, provide charge transport layers having good coating quality. However, chlorinated solvents have environmental safety problems. As a result, the use of these solvents requires solvent abatement systems in order to eliminate leakage. Therefore, non-chlorinated solvent systems that provide coating qualities similar to or better than those of chlorinated solvent systems are desired.

SUMMARY OF THE INVENTION

The present invention is directed to a process for preparing an electrophotographic imaging member having a charge transport layer applied using non-chlorinated solvents. The process comprises forming a solution of a charge transport material in a solvent system comprising at least two non-chlorinated solvents selected from the group consisting of tetrahydrofuran, dioxane and toluene and applying the solution to an electrophotographic imaging member by solution coating.

Applying charge transport layers using the above non-chlorinated solvent systems provides charge transport layers having good coating quality. In addition, the above solvent systems do not contain chlorinated solvents and therefore do not require the use of solvent abatement systems in order to eliminate leakage.

DETAILED DESCRIPTION OF THE PREFERRED EMBODIMENTS

The present invention relates to a method of forming a charge transport layer by a solution coating process. In the present invention, any suitable charge transport material may be applied to the substrate or other layer of the photoreceptor. In the present invention, the charge transport material is dissolved in a solvent for application of the charge transport layer. Preferably, the charge transport material is dispersed in a film-forming binder and the resulting dispersion is dissolved in a solvent.

The charge transport solution formed thereby generally contains from about 50 to 95% by weight solvent. Preferably, the dispersion comprises 70 to 85% by weight solvent.

The solvent system for use in embodiments of the present invention comprises at least two non-chlorinated solvents selected from the group consisting of tetrahydrofuran, dioxane and toluene. As used herein, dioxane refers to 1,3-dioxane, 1,4-dioxane or a mixture thereof. Preferably, the solvent system comprises tetrahydrofuran and at least one of dioxane and toluene. More preferably the solvent system comprises tetrahydrofuran and 1,4-dioxane.

The solvent system generally comprises from about 10 to 90% by weight of each non-chlorinated solvent. In a preferred embodiment of the invention, chlorinated solvents are excluded from the solvent system.

The charge transport dispersion may be applied to the substrate or other layer of the photoreceptor by any known solution coating technique. Solution coating techniques that may be used include, but are not limited to, dip coating, spray coating, blade/knife coating, roll coating and curtain flow coating. In the present invention, dip coating is a preferred technique for applying the charge transport layer.

The charge transport layer formed by the process of the present invention may comprise any suitable organic polymer or non-polymeric material capable of transporting charge to selectively discharge the surface charge. Charge transporting materials suitable for use in the present invention include, but are not limited to, a mixture of one or more transporting aromatic amines, hydrozons, etc. Exemplary aromatic amines include triaryl amines such as triphenyl amines, poly triaryl amines, bisarylamine ethers and bis-alkylaryl amines.

Preferred bisarylamine ethers include, but are not limited to, bis(4-diethylamine-2-methylpheny)phenylmethane and 4'4"-bis(diethylamino)-2'2"-dimethyltriphenylmethane. Preferred bisalkylaryl amines include, but are not limited to, N,N'-bis(alkylpheny)(1,1'-biphenyl)-4,4'-diamine, wherein the alkyl is, for example, methyl, ethyl, propyl, n-butyl, and the like. Meta-tolyl-bis-diphenylamino-benzadine and N,N'-diphenyl-N,N'-bis(3"-methylphenyl)-(1,1'-biphenyl)-4,4'-diamine are preferred transporting aromatic amines.

The concentration of charge transport material in the layer may generally vary from about 5 to 100 percent by weight of the layer. A photogenerating layer comprising 100 percent charge transport material may be prepared by coating a binderless dispersion of the charge transport material onto the substrate or other layer of the photoreceptor. When the charge transport material is present in a binder material, the binder preferably contains from about 20 to about 95 percent by weight of the photogenerating material, and more preferably from about 40 to about 80 percent by weight of the photogenerating material.

Any suitable polymeric binder material may be employed as a matrix in the charge transport layer. The binder preferably adheres well to the substrate or other underlying layer and dissolves in the solvent system. Exemplary film-forming binders for use in the present invention include, but are not limited to, polycarbonate, polyvinylcarbazole, polyester, polyarylate, polyacrylate, polyether and polysulfone. Weight average molecular weights of the resin binders can vary from about 20,000 to about 1,500,000.

Preferred resin materials are polycarbonate resins having molecular weights from about 20,000 to about 120,000, more preferably from about 50,000 to about 100,000. Highly preferred resin materials are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000 available as Lexan 141 from General Electric Company; polycarbonate resin having a molecular weight of from about 50,000 to about 100,000, available as Makrolon from Farben Fabricken Bayer A. G.; polycarbonate resin having a weight average molecular weight of from about 20,000 to about 50,000 available as Merlon from Mobay Chemical Company; polycarbonate resin having a molecular weight of about 200,000 to about 1,000,000, available from Mitsubishi Chem. Co., Japan; polyether carbonates; and 4,4'-cyclohexylidene diphenyl polycarbonate.

Exemplary charge transport layer thicknesses formed according to the present invention include, but are not limited to, thicknesses ranging from about 1.0 micrometer to about 50 micrometers, and preferably from about 10 micrometers to about 40 micrometers. Charge transport layer thickness generally depends on film-forming binder content. Higher binder content generally results in thicker charge transport layers. Thicknesses outside the above exemplary ranges are also within the scope of the invention.

The charge transport layer should preferably exhibit negligible, if any, discharge when exposed to a wavelength of light useful in xerography, e.g., 4000 Angstroms to 9000 Angstroms. Therefore, the charge transport layer is substantially transparent to radiation in a region in which the photoreceptor operates.

The electrophotographic imaging member formed by the process of the present invention generally contains a charge generating layer in addition to the charge transport layer. The charge generating layer generally comprises a resin dispersed pigment. Charge generating layers may be formed by any conventional materials and methods, such as the materials and methods disclosed in U.S. Pat. No. 5,521,047 to Yuh et al., the disclosure of which is incorporated herein by reference. In an embodiment of the present invention, the charge generating layer comprises a perylene-containing charge generating material.

In a further embodiment of the present invention, the electrophotographic imaging member formed by the process of the present invention comprises a perylene-containing charge generating layer, a charge transport layer and an interface region between the charge generating layer and the charge transport layer. The interface region may contain a mixture of charge transport material and charge generating material. In a further embodiment of the invention, the interface region is formed by applying a charge transport material to an underlying layer of perylene-containing charge generating material prior to drying or curing the underlying layer, as disclosed in U.S. Pat. No. 5,521,047 to Yuh et al.

In an additional embodiment of the present invention, an electrophotographic imaging member is formed having one or more additional layers, such as a substrate, a conductive layer, a blocking layer, an adhesive layer and/or a protective overcoating layer. The layers may be prepared and applied using conventional materials and methods.

The invention will be further illustrated in the following examples, it being understood that the examples are illustrative only and that the invention is not limited to the materials, conditions, process parameters and the like recited therein.

EXAMPLE 1

A nylon charge blocking layer is fabricated from an 8% by weight solution of nylon in a butanol, methanol and water mixture. The butanol, methanol and water mixture percentages are 55, 36 and 9% by weight, respectively. The charge blocking layer is dip coated onto an aluminum drum substrate having a diameter of 84 mm and a length of 310 mm and is dried at a temperature of about 105° C. for about 5 minutes. The dried nylon containing blocking layer has a thickness of about 1.5 microns.

To form a charge generating layer, a dispersion is prepared by milling a solution containing 8% by weight benzimidazole perylene, 4% by weight polyvinylbutyral B79 (Mansanto Chem. Co.), and 88% by weight n-butylacetate. The dispersion is then diluted with a mixture of n-butylacetate and ethylacetate (1/1 by weight) to form a dispersion having a 5% by weight solids content. The dispersion is then dip coated onto the charge blocking layer and allowed to dry in ambient air (temperature=25° C. and relative humidity=25%). The dried charge generating layer has a thickness of about 0.5 micron.

A charge transport layer is prepared from a 24% by weight solids solution of N,N'-diphenyl-N,N'-bis-(3-methylphenyl)-(1,1'-biphenyl)-4,4'diamine and a polycarbonate resin, PCZ400 (from Mitsubishi Chem. Co., Japan) in a solvent system comprising 57 wt. % tetrahydrofuran and 43 wt. % 1,4-dioxane. The weight ratio of the diamine to the polycarbonate resin therein is 2 to 3.

To form the dispersion, the polycarbonate resin is dissolved in the solvent first. Then the diamine molecules are completely dissolved into the resin solution. The transport layer solution is then coated onto the charge generating layer by dip coating. To dip coat the layer, the drum is chucked at the top and immersed into the transport layer solution. In order to form a charge transport layer having a dry thickness of about 18 microns, the drum is pulled out of the solution with a 50 mm per minute pull rate.

The wet coated film is allowed to air dry for 5 minutes at 25° C. and 25% relative humidity, then dried in a forced air oven for 20 minutes at 130° C. The thicknesses of the dried film at various points on the drum are measured by an Otsuka gauge (MCPD-1000, available from Otsuka Electronics Co., Ltd.) and are reported in Table 1. With a dip coating process, the coating on the top portion of the drum starts from zero and increases gradually to the desired thickness. With this solvent mixture, the film thickness reaches the desired 18 microns at 20 mm from the top of the film.

EXAMPLE 2

A photoreceptor is formed by the process of Example 1, except the drum is pulled out of the solution with a 70 mm per minute pull rate in order to form a charge transport layer having a dry thickness of about 24 microns. The thicknesses of the dried film at various points on the drum are measured by an Otsuka gauge and are reported in Table 1. With this solvent mixture, the film thickness reaches the desired 24 microns at 40 mm from the top of the film.

EXAMPLE 3

A nylon charge blocking layer and a charge generating layer are fabricated as in Example 1. A charge transport layer is prepared from a 22.5% by weight solids solution of N,N'-diphenyl-N,N'-bis(3-methylphenyl)-(1,1'-biphenyl)-4,4'diamine and a polycarbonate resin, PCZ400 (from Mitsubishi Chem. Co., Japan) in a solvent system comprising 80 wt. % tetrahydrofuran and 20 wt. % toluene. The weight ratio of the diamine to the polycarbonate resin therein is 2 to 3.

To form the dispersion, the polycarbonate resin is dissolved in the solvent first. Then the diamine molecules are completely dissolved into the resin solution. The transport layer solution is then coated onto the charge generating layer by dip coating. To dip coat the layer, the drum is chucked at the top and immersed into the transport layer solution. In order to form a charge transport layer having a dry thickness of about 18 microns, the drum is pulled out of the solution with a 70 mm per minute pull rate.

The wet coated film is allowed to air dry for 5 minutes at 25° C. and 25% relative humidity, then dried in a forced air oven for 20 minutes at 130° C. The thicknesses of the dried film at various points on the drum are measured by an Otsuka gauge and are reported in Table 1. With this solvent mixture, the film thickness reaches the desired 18 microns at 20 mm from the top of the film.

EXAMPLE 4

A photoreceptor is formed by the process of Example 3, except the drum is pulled out of the solution with a 110 mm per minute pull rate in order to form a charge transport layer having a dry thickness of about 24 microns. The thicknesses of the dried film at various points on the drum are measured by an Otsuka gauge and are reported in Table 1. With this solvent mixture, the film thickness reached the desired 24 microns at 40 mm from the top of the film.

COMPARATIVE EXAMPLE 1

A nylon charge blocking layer and a charge generating layer are fabricated as in Example 1. A charge transport layer is prepared from a 18.1% by weight solids solution of N,N'-diphenyl-N,N'-bis(3-methylphenyl)-(1,1'-biphenyl)-4,4'diamine and polycarbonate resin, PCZ400 (from Mitsubishi Chem. Co., Japan) in monochlorobenzene. The weight ratio of the diamine to the polycarbonate resin therein is 2 to 3.

To form the dispersion, the polycarbonate resin was dissolved in the solvent first. Then the diamine molecules are completely dissolved into the resin solution. The transport layer solution is then coated onto the charge generating layer by dip coating. To dip coat the layer, the drum is chucked at the top and immersed into the transport layer solution. In order to form a charge transport layer having a dry thickness of about 18 microns, the drum is pulled out of the solution with a 110 mm per minute pull rate.

The wet coated film is allowed to air dry for 5 minutes at 25° C. and 25% relative humidity, then dried in a forced air oven for 20 minutes at 130° C. The thicknesses of the dried film at various points on the drum are measured by an Otsuka gauge and are reported in Table 1. With the monochlorobenzene solvent, the film thickness does not reach the desired 18 microns until 50 mm from the top of the film.

COMPARATIVE EXAMPLE 2

A photoreceptor is formed by the process of Comparative Example 1, except the drum is pulled out of the solution with a 155 mm per minute pull rate in order to form a charge transport layer having a dry thickness of about 24 microns. The thicknesses of the dried film at various points on the drum are measured by an Otsuka gauge and are reported in Table 1. With the monochlorobenzene solvent, the film thickness does not reach the desired 24 microns until 200 mm from the top of the film. Such a film thickness gradient causes image quality variation and cannot be used for imaging purposes.

TABLE 1

| Transport Layer Solvents | Distance From Top of Film (mm) | Measured Film Thickness (μm) & Circumferential Uniformity (+/− range) for 18 μm Film Thickness | Measured Film Thickness (μm) & Circumferential Uniformity (+/− range) for 24 μm Film Thickness |
|---|---|---|---|
| Tetrahydrofuran/ 1,4-Dioxane (Examples 1 and 2) | 10 | 15.0+/−0.2 | 22.4+/−1.0 |
| | 20 | 17.9+/−0.1 | 23.3+/−0.1 |
| | 30 | 18.0+/−0.1 | 23.5+/−0.1 |
| | 40 | 18.0+/−0.1 | 23.9+/−0.1 |
| | 50 | 18.0+/−0.1 | 24.0+/−0.1 |
| | 100 | 18.2+/−0.1 | 24.0+/−0.1 |
| | 200 | 18.4+/−0.1 | 24.0+/−0.1 |
| | 250 | 18.4+/−0.1 | 24.0+/−0.1 |
| | 300 | 18.8+/−0.1 | 25.0+/−0.1 |

TABLE 1-continued

| Transport Layer Solvents | Distance From Top of Film (mm) | Measured Film Thickness (μm) & Circumferential Uniformity (+/− range) for 18 μm Film Thickness | Measured Film Thickness (μm) & Circumferential Uniformity (+/− range) for 24 μm Film Thickness |
|---|---|---|---|
| Tetrahydrofuran/ Toluene (Examples 3 and 4) | 10 | 17.8+/−0.5 | 22.4+/−0.3 |
| | 20 | 18.1+/−0.4 | 22.9+/−0.5 |
| | 30 | 18.0+/−0.5 | 23.5+/−0.3 |
| | 40 | 18.0+/−0.3 | 24.0+/−0.3 |
| | 50 | 17.9+/−0.1 | 24.1+/−0.2 |
| | 100 | 18.0+/−0.1 | 24.2+/−0.1 |
| | 200 | 18.3+/−0.1 | 24.3+/−0.1 |
| | 250 | 18.5+/−0.1 | 24.1+/−0.1 |
| | 300 | 18.5+/−0.1 | 24.7+/−0.1 |
| Monochlorobenzene (Comparative Examples 1 and 2) | 10 | 11.0+/−0.4 | 11.0+/−0.9 |
| | 20 | 13.0+/−0.5 | 13.5+/−0.7 |
| | 30 | 15.5+/−0.5 | 15.2+/−0.7 |
| | 40 | 17.5+/−0.3 | 15.5+/−0.5 |
| | 50 | 17.9+/−0.2 | 17.2+/−0.7 |
| | 100 | 18.2+/−0.1 | 21.5+/−0.5 |
| | 200 | 18.4+/−0.1 | 24.5+/−0.6 |
| | 250 | 18.7+/−0.1 | 24.8+/−0.6 |
| | 300 | 19.4+/−0.1 | 25.1+/−0.7 |

EXAMPLE 5

A photoreceptor is formed by the process of Example 1, except the drum is pulled out of the solution with a 110 mm per minute pull rate in order to form a charge transport layer having a dry thickness of about 28 microns. The thicknesses of the dried film at various points on the drum are measured by an Otsuka gauge and are reported in Table 2.

COMPARATIVE EXAMPLE 3

A photoreceptor is formed by the process of Comparative Example 1, except the drum is pulled out of the solution with a 175 mm per minute pull rate in order to form a charge transport layer having a dry thickness of about 28 microns. The thicknesses of the dried film at various points on the drum are measured by an Otsuka gauge and are reported in Table 2.

TABLE 2

| Transport Layer Solvents | Distance From Top of Film (mm) | Measured Film Thickness (μm) & Circumferential Uniformity (+/− range) for 28 Micron Film Thickness |
|---|---|---|
| Tetrahydrofuran/ 1,4-Dioxane (Example 5) | 10 | 18.0+/−0.6 |
| | 20 | 21.8+/−0.6 |
| | 30 | 24.9+/−0.5 |
| | 40 | 26.7+/−0.6 |
| | 50 | 27.1+/−0.4 |
| | 100 | 28.5+/−0.3 |
| | 200 | 28.6+/−0.3 |
| | 250 | 29.1+/−0.3 |
| | 300 | 29.1+/−0.4 |
| Monochlorobenzene (Comparative Example 3) | 10 | 12.1+/−0.4 |
| | 20 | 13.5+/−0.5 |
| | 30 | 13.5+/−0.9 |
| | 40 | 14.0+/−1.0 |
| | 50 | 17.5+/−0.9 |
| | 100 | 22.4+/−0.8 |
| | 200 | 28.6+/−1.2 |
| | 250 | 27.5+/−1.1 |
| | 300 | 26.5+/−0.8 |

EXAMPLE 6

A photoreceptor is formed by the process of Example 1, except the drum is pulled out of the solution with a 130 mm per minute pull rate in order to form a charge transport layer having a dry thickness of about 35 microns. The thicknesses of the dried film at various points on the drum are measured by an Otsuka gauge and are reported in Table 3.

TABLE 3

| Transport Layer Solvents | Distance From Top of Film (mm) | Measured Film Thickness (μm) & Circumferential Uniformity (+/− range) for 35 Micron Film Thickness |
|---|---|---|
| Tetrahydrofuran/ 1,4-Dioxane (Example 6) | 10 | 24.0+/−0.5 |
| | 20 | 29.0+/−0.7 |
| | 30 | 33.3+/−0.4 |
| | 40 | 33.7+/−0.8 |
| | 50 | 34.2+/−0.6 |
| | 100 | 35.2+/−0.4 |
| | 200 | 35.1+/−0.3 |
| | 250 | 35.5+/−0.5 |
| | 300 | 35.3+/−0.6 |

While the invention has been described with reference to preferred embodiments, the invention is not limited to the specific examples given and other embodiments and modifications can be made by those of ordinary skill in the art without departing from the spirit and scope of the invention and claims.

What is claimed is:

1. A process for preparing an electrophotographic imaging member comprising forming a solution comprising a charge transport material and a solvent system consisting essentially of 10 to 90% by weight tetrahydrofuran and 10 to 90% by weight toluene, and applying the solution to a layer of an electrophotographic imaging member to form a charge transport layer, wherein said charge transport material is an aromatic amine.

2. The process according to claim 1, wherein said solution further comprises a film-forming binder.

3. The process according to claim 2, wherein said film forming binder is a polycarbonate.

4. The process according to claim 3, wherein said polycarbonate has a weight average molecular weight of 20,000 to 150,000.

5. The process according to claim 1, wherein said layer of an electrophotographic imaging member is a charge generation layer.

6. The process according to claim 1, wherein said layer of an electrophotographic imaging member is a substrate.

7. The process according to claim 1, wherein a charge generation layer is applied to said charge transport layer.

8. The process according to claim 1, wherein said charge transport layer is applied by solution coating.

9. The process according to claim 1, wherein said charge transport layer is formed by dip coating.

10. A solution for forming a charge transport layer comprising a charge transport material and a solvent system consisting essentially of 10 to 90% by weight tetrahydrofuran and 10 to 90% by weight toluene, wherein said charge transport material is an aromatic amine.

11. The solution according to claim 10, further comprising a film-forming binder.

12. The solution according to claim 11, wherein said film forming binder is a polycarbonate.

13. The solution according to claim 12, wherein said polycarbonate has a weight average molecular weight of 20,000 to 150,000.

14. A solution for forming a charge transport layer comprising a charge transport material and a solvent system comprising tetrahydrofuran, toluene and a dioxane.

15. The solution according to claim 14, wherein said solvent system comprises 1,4-dioxane.

16. The solution according to claim 14, wherein said charge transport material is an aromatic amine.

17. The solution according to claim 14, further comprising a film-forming binder.

18. The solution according to claim 17, wherein said film forming binder is a polycarbonate.

19. A process for preparing an electrophotographic imaging member comprising forming a solution according to claim 14, and applying the solution to a layer of an electrophotographic imaging member to form a charge transport layer.

20. The process according to claim 19, wherein said solvent system comprises 1,4-dioxane.

21. The process according to claim 19, wherein said charge transport material is an aromatic amine.

* * * * *